US007791466B2

(12) United States Patent
Agarwalla et al.

(10) Patent No.: US 7,791,466 B2
(45) Date of Patent: Sep. 7, 2010

(54) SYSTEM AND METHOD FOR EVENT DETECTION UTILIZING SENSOR BASED SURVEILLANCE

(75) Inventors: Lalit Agarwalla, Bangalore (IN); Sergio Borger, Paramus, NJ (US); Lisa M. Brown, Pleasantville, NY (US); Christopher R. Carlson, Costa Mesa, CA (US); Raymond A. Cooke, Bloomington, MN (US); Barry Gottlieb, Short Hills, NJ (US); Arun Hampapur, Norwalk, CT (US); Christopher A. LoGiudice, Bethel, CT (US); Linda C. Owen, Counce, TN (US); Andrew W. Senior, New York, NY (US); Chiao-Fe Shu, Scarsdale, NY (US)

(73) Assignee: International Business Machines Corporation, Armonk, NY (US)

( * ) Notice: Subject to any disclaimer, the term of this patent is extended or adjusted under 35 U.S.C. 154(b) by 243 days.

(21) Appl. No.: 11/972,765

(22) Filed: Jan. 11, 2008

(65) Prior Publication Data

US 2008/0252448 A1 Oct. 16, 2008

Related U.S. Application Data

(60) Provisional application No. 60/884,867, filed on Jan. 12, 2007.

(51) Int. Cl.
*G08B 23/00* (2006.01)

(52) U.S. Cl. ..... 340/517; 340/506; 340/3.1; 340/825.36; 340/825.49

(58) Field of Classification Search ..... 340/506, 340/3.1, 825.36, 825.49
See application file for complete search history.

(56) References Cited

U.S. PATENT DOCUMENTS 5,400,246 A * 3/1995 Wilson et al. ..... 700/17

* cited by examiner

*Primary Examiner*—Daryl Pope
(74) *Attorney, Agent, or Firm*—Anna Linne; Hoffman Warnick LLC

(57) ABSTRACT

The present invention includes a method, system, and program product for detecting an event that includes receiving at least one data input stream from one or more sensors, selecting a data input stream from one of the one or more sensors, recording the data input stream on a recordable medium, specifying a rule comprising an event in the data input stream, and detecting at least one event in the data input stream based upon the rule.

20 Claims, 9 Drawing Sheets

SYSTEM AND METHOD FOR EVENT DETECTION UTILIZING SENSOR BASED SURVEILLANCE

CROSS-REFERENCE TO RELATED APPLICATION

The present application claims the benefit of provisional patent application No. 60/884,867, entitled SYSTEM AND METHOD FOR EVENT DETECTION UTILIZING SENSOR BASED SURVEILLANCE, filed Jan. 12, 2007, the entire contents of which are herein incorporated by reference.

FIELD OF THE INVENTION

The present invention generally relates to event detection in surveillance systems. Specifically, aspects of the present invention address a need for event detection and alert generation based upon physical location and sensor based surveillance.

BACKGROUND OF THE INVENTION

Theft and shoplifting significantly impact the profitability of retail establishments. Thus, detecting malefactors pursuing such activities is of paramount importance, as the competitive landscape in retail sales has grown significantly more challenging in recent years. Also, events in the last decade have demonstrated the need for improved surveillance and detection of suspicious activities to deter violent attacks. Current surveillance systems do not adequately address these requirements. In view of the foregoing, there exists a need for a solution that solves at least one of the deficiencies of the related art.

SUMMARY OF THE INVENTION

In general, the present invention provides a smart security system in which a data input stream from one or more sensors (e.g., cameras) is received and recorded. Based on a specified rule, an event in the data input stream can be detected. The detection of the event is performed substantially contemporaneously with the receipt of the data input stream from the one of the one or more sensors, or based upon receipt of the data input stream from playback of the recordable medium. Based on the detection of the event, an alert can be generated. This alert can comprise identifying the particular sensor from which the data input stream was received (e.g., depicting its location on a map). The specification of the rule can comprise marking an annotation (e.g., a boundary line) on the data input stream.

A first aspect of the present invention provides a method for detecting an event, comprising receiving at least one data input stream from one or more sensors, selecting a data input stream from one of the one or more sensors, recording the data input stream on a recordable medium, specifying a rule comprising an event in the data input stream, and detecting at least one event in the data input stream based upon the rule.

A second aspect of the present invention provides a system for detecting an event, comprising means for receiving at least one data input stream from one or more sensors, means for selecting a data input stream from one of the one or more sensors, means for recording the data input stream on a recordable medium, means for specifying a rule comprising an event in the data input stream, and means for detecting at least one event in the data input stream based upon the rule.

A third aspect of the present invention provides a method for deploying a system for detecting an event, comprising providing a computer infrastructure being operable to receive at least one data input stream from one or more sensors, select a data input stream from one of the one or more sensors, record the data input stream on a recordable medium, specify a rule comprising an event in the data input stream, and detect at least one event in the data input stream based upon the rule.

A fourth aspect of the present invention provides a program product stored on a computer readable medium for detecting an event, the computer readable medium comprising program code for causing a computer system to: receive at least one data input stream from one or more sensors, select a data input stream from one of the one or more sensors, record the data input stream on a recordable medium, specify a rule comprising an event in the data input stream, and detect at least one event in the data input stream based upon the rule.

BRIEF DESCRIPTION OF THE DRAWINGS

These and other features of this invention will be more readily understood from the following detailed description of the various aspects of the invention taken in conjunction with the accompanying drawings in which:

FIGS. 10-24 depict loss prevention management aspects of the present invention.

FIGS. 25-56 depict store management aspects of the present invention.

Figure 1:
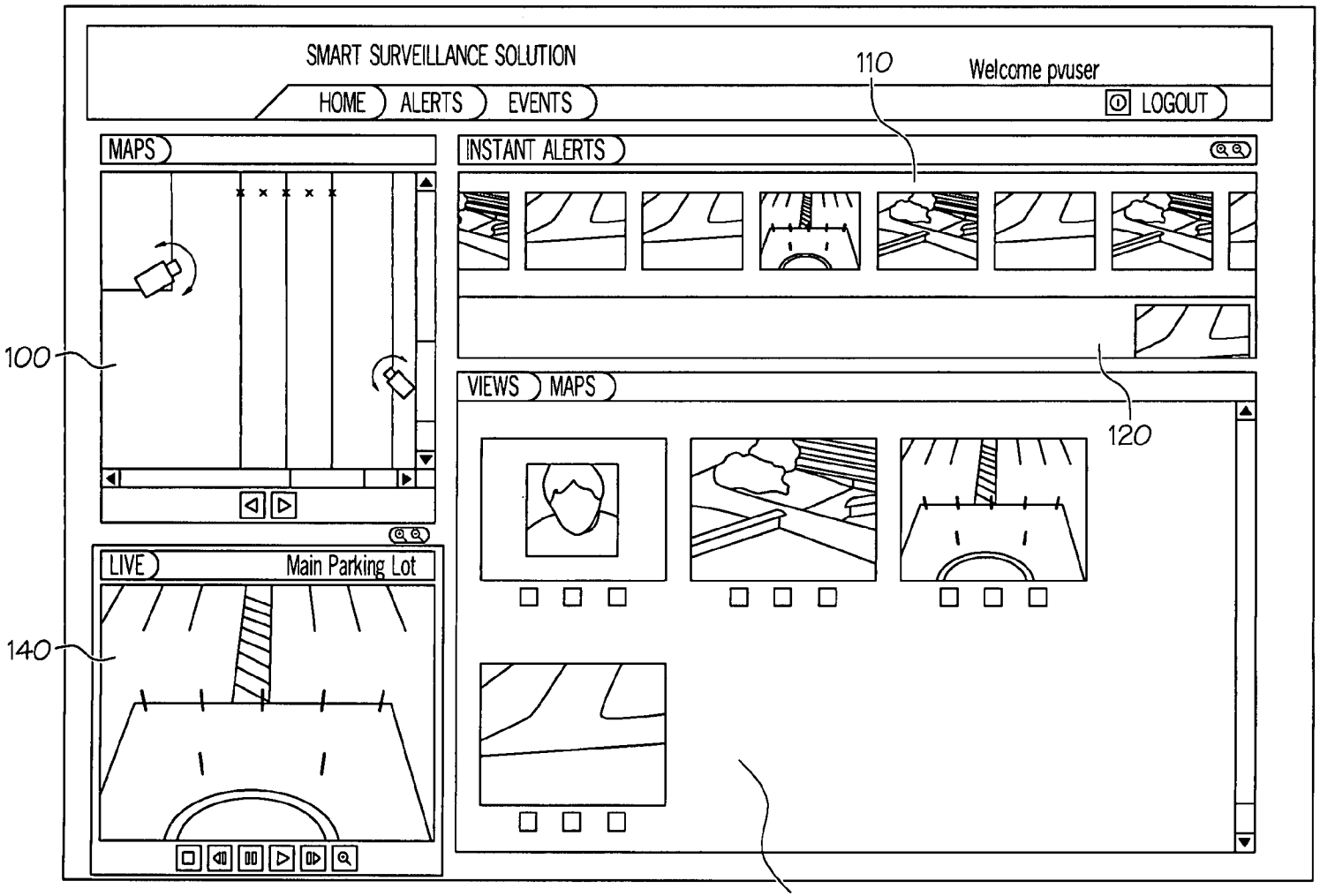
FIGS. 1-9 depict a graphical user interface according to the present invention.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION OF THE INVENTION

As indicated above, the present invention provides a smart security system in which a data input stream from one or more sensors (e.g., cameras) is received and recorded. Based on a specified rule, an event in the data input stream can be detected. The detection of the event is performed substantially contemporaneously with the receipt of the data input stream from the one of the one or more sensors, or based upon receipt of the data input stream from playback of the recordable medium. Based on the detection of the event, an alert can be generated. This alert can comprise identifying the particular sensor from which the data input stream was received (e.g., depicting its location on a map). The specification of the rule can comprise marking an annotation (e.g., a boundary line) on the data input stream.

FIG. 1 shows the user interface with 4 basic zones. Element 100 shows the map of the facility with the location of sensors (e.g. cameras) on them. The color of the shaded zone on the camera shows the status of alerts on the cameras, for example, green is no alert, yellow is alert of type #1, orange is alert of type #2, red is alert of type #3 etc. Element 110 shows the real-time alert visualization zone. Each alert is reported in this zone within a short time (i.e. substantially contemporaneously) of the occurrence of the event. An alert is reported by automatically placing a key-image from the camera onto the zone and sounding an audible alarm (tone or voice announcement). As the zone fills up the alert notifications are scrolled from left to right with a scroll bar which allows the user to browse through the various alert notifications. The user can choose to view the view corresponding to any of the alerts by clicking on the alerts.

Element 120 shows an expanded summary of alerts that have occurred in the system. Each alert is represented by a different colored bar, thus allowing the user to visually assess the type of alerts that occur frequently and the pattern in which alerts occur, for example, yellow followed by green, followed by red may indicate that these they alerts typically fire in a sequence. Element 130 shows a thumbnail taken from each of the cameras connected to the Smart Surveillance System (a.k.a "S3"). Below each camera view (a.k.a. data input stream) are buttons which allow the user to select the camera, and launch the alert configuration tool. Also, data input streams may be recorded on a recordable medium.

Figure 2:
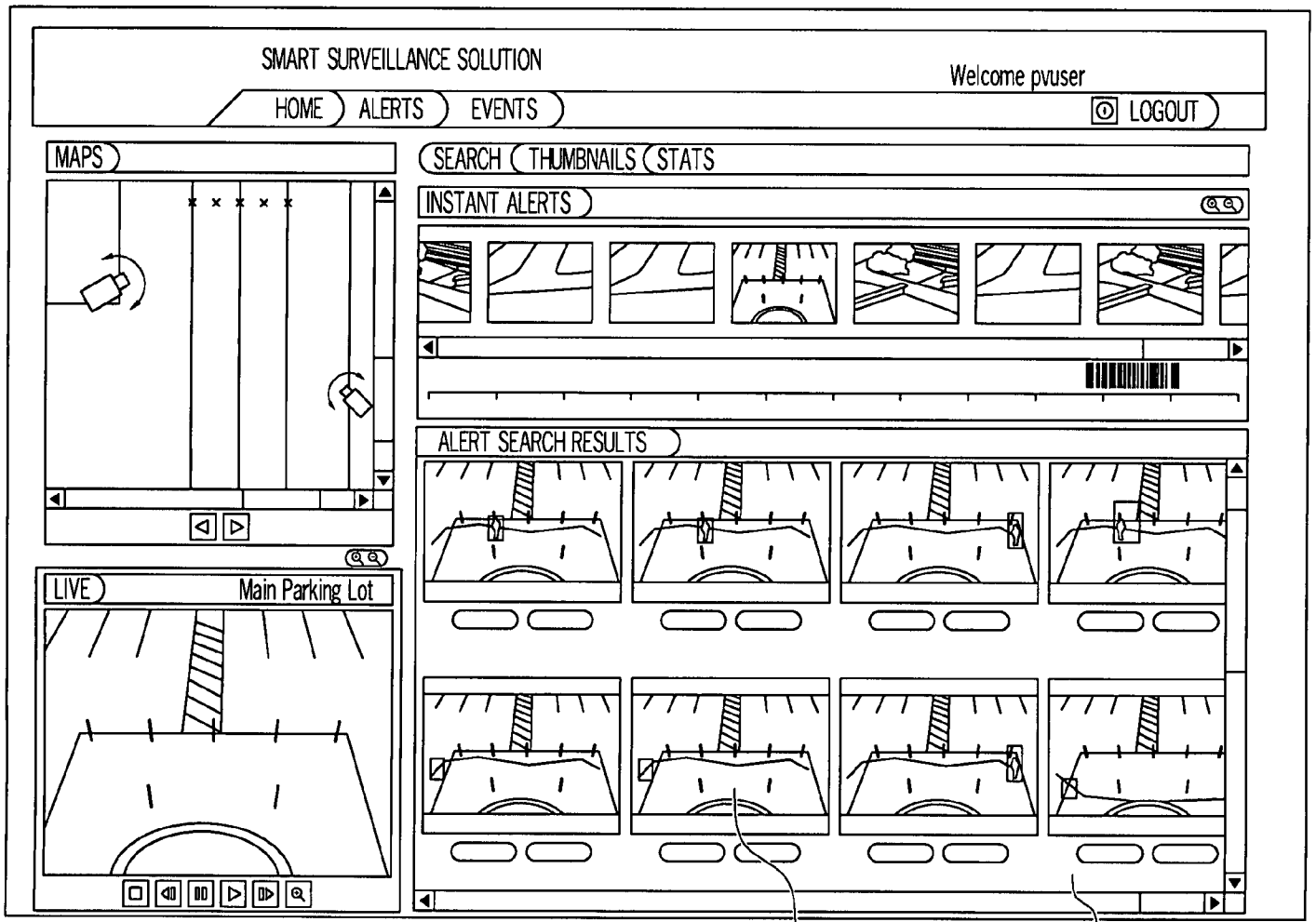

FIG. 2 shows the user interface where the user is browsing thru the last 100 alerts for a selected camera. Element 210 is the zone where the keyframes from each of the alerts is displayed. Element 220 is a single keyframe which represents the occurrence of a user defined alert. The key frame is selected from the camera and shows the object that is triggering the alert rule that has been set up by the user.

Figure 3:
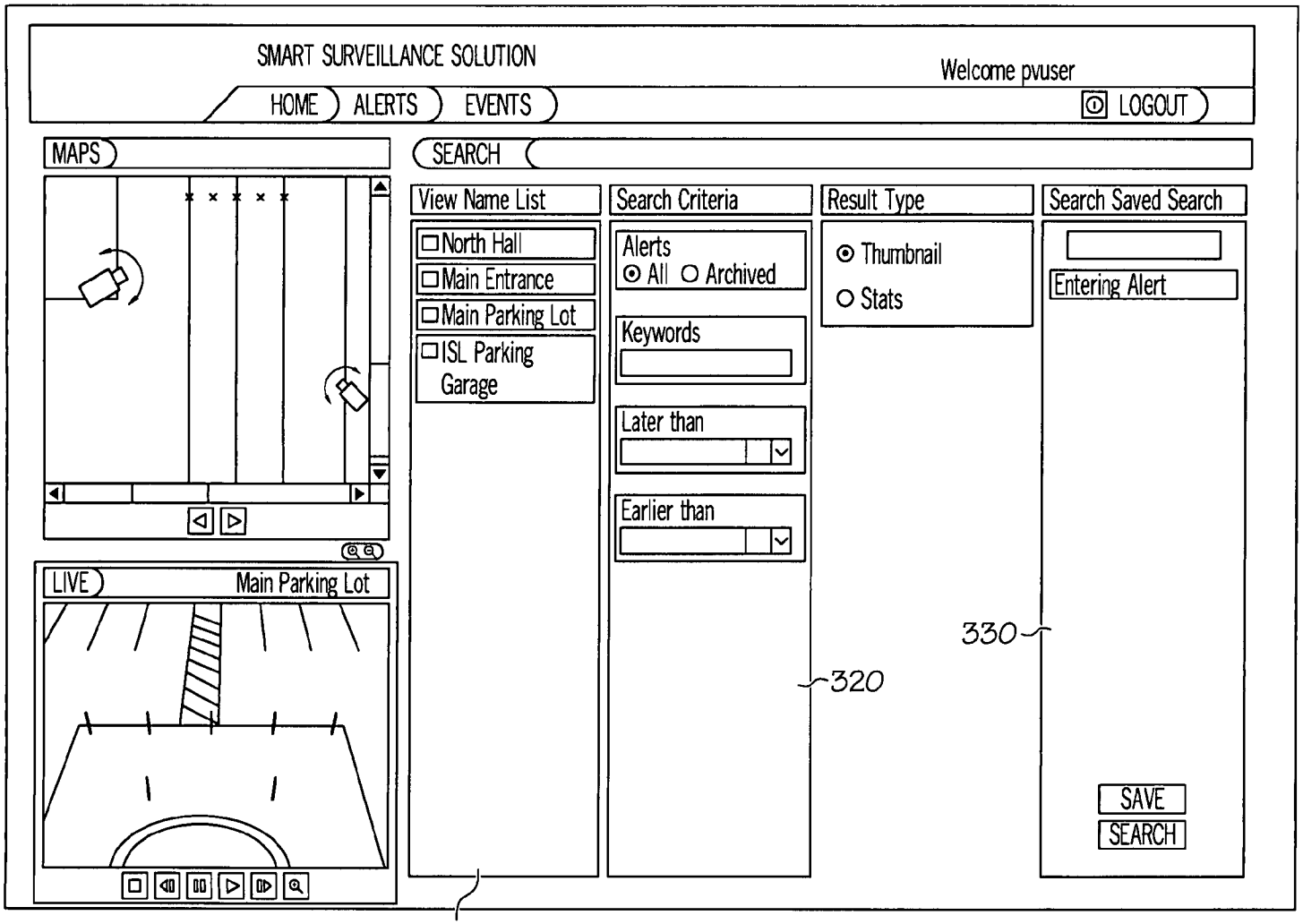

FIG. 3 shows the user interface for searching through the database of alerts. Element 310 shows the list of cameras in the system. The user can select one or more cameras to perform the alert search. Element 320 shows the various criteria for searching thru alerts including: 1) Keyword (this is the title of the alert), 2) Time Interval Start, and 3) Time Interval End. Element 330 shows the list of previously saved alert searches and provides the user with a mechanism to save a particular search.

Figure 4:
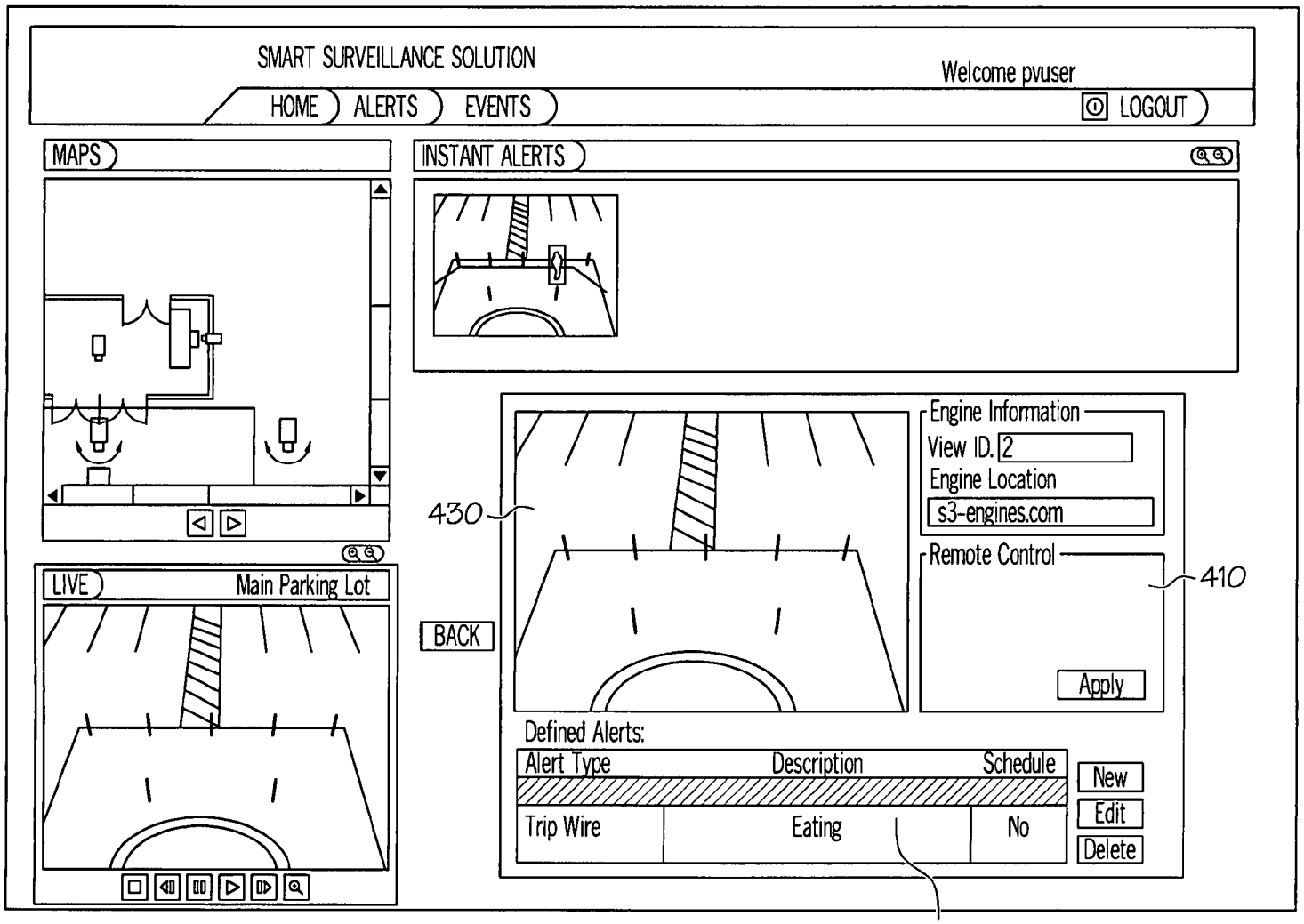

FIG. 4 shows the user interface where the user can setup a variety of alert definitions. Element 410 is a window where the user can setup the alert. Element 420 shows the list of alerts which are currently setup on the camera; the user can edit, or delete existing alerts. Element 430 shows the process of defining an alert using a mouse (drawing zones of interest, no interest, defining rules, etc).

Figure 5:
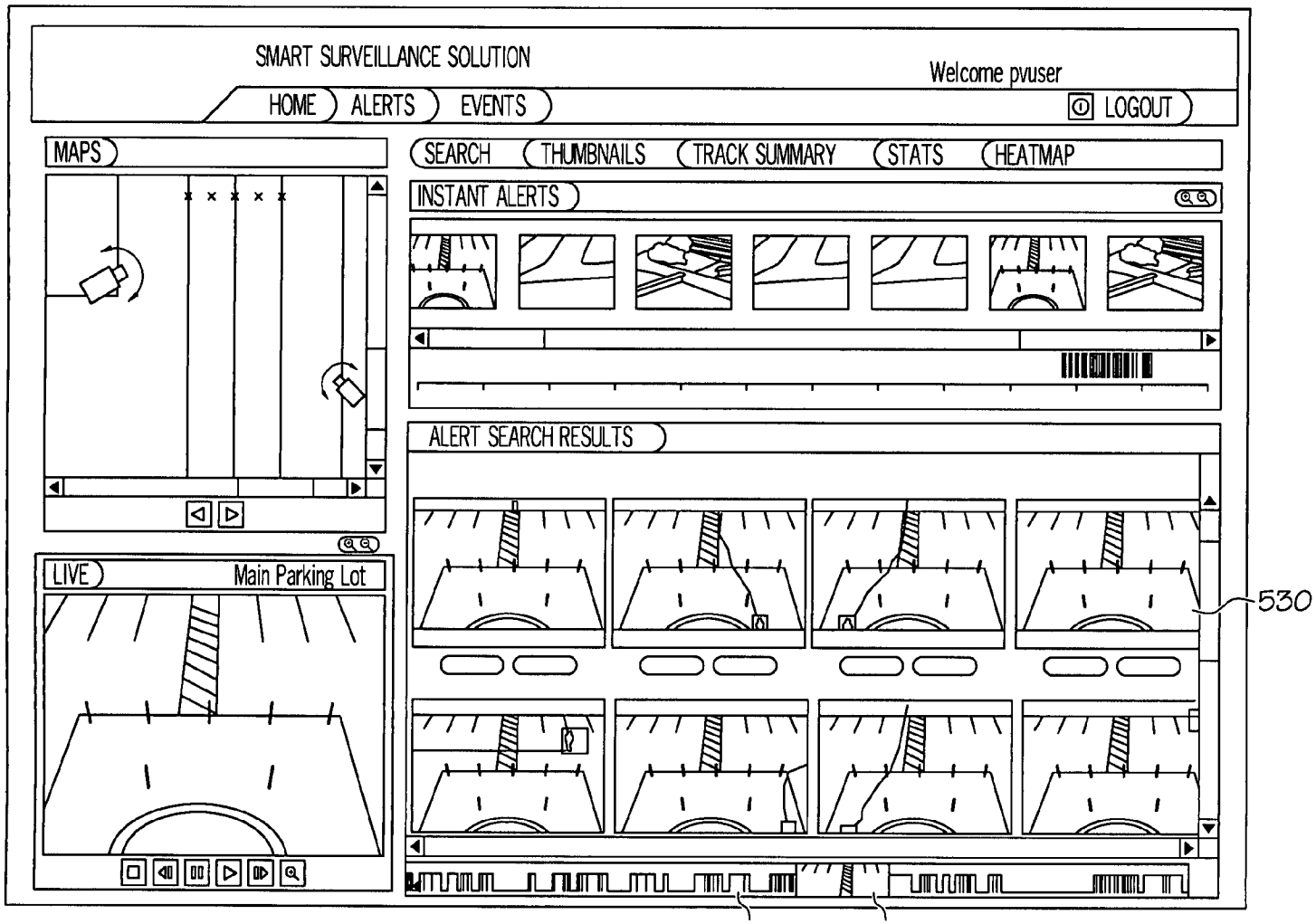

FIG. 5 shows the event thumbnail view. Here the user is browsing through the results of a search query. Element 510 shows the timeline of various events, each green bar represents an event, thus allowing the user to visually observe a pattern of events that have occurred over a period of time. Element 520 shows an event keyframe that pops up when the user performs a mouse-over operation on the event markers. Element 530 shows the keyframe that represents each event. The key frame is annotated with the trajectory of the object and the coloring of the trajectory indicates the direction of movement of the object.

Figure 6:
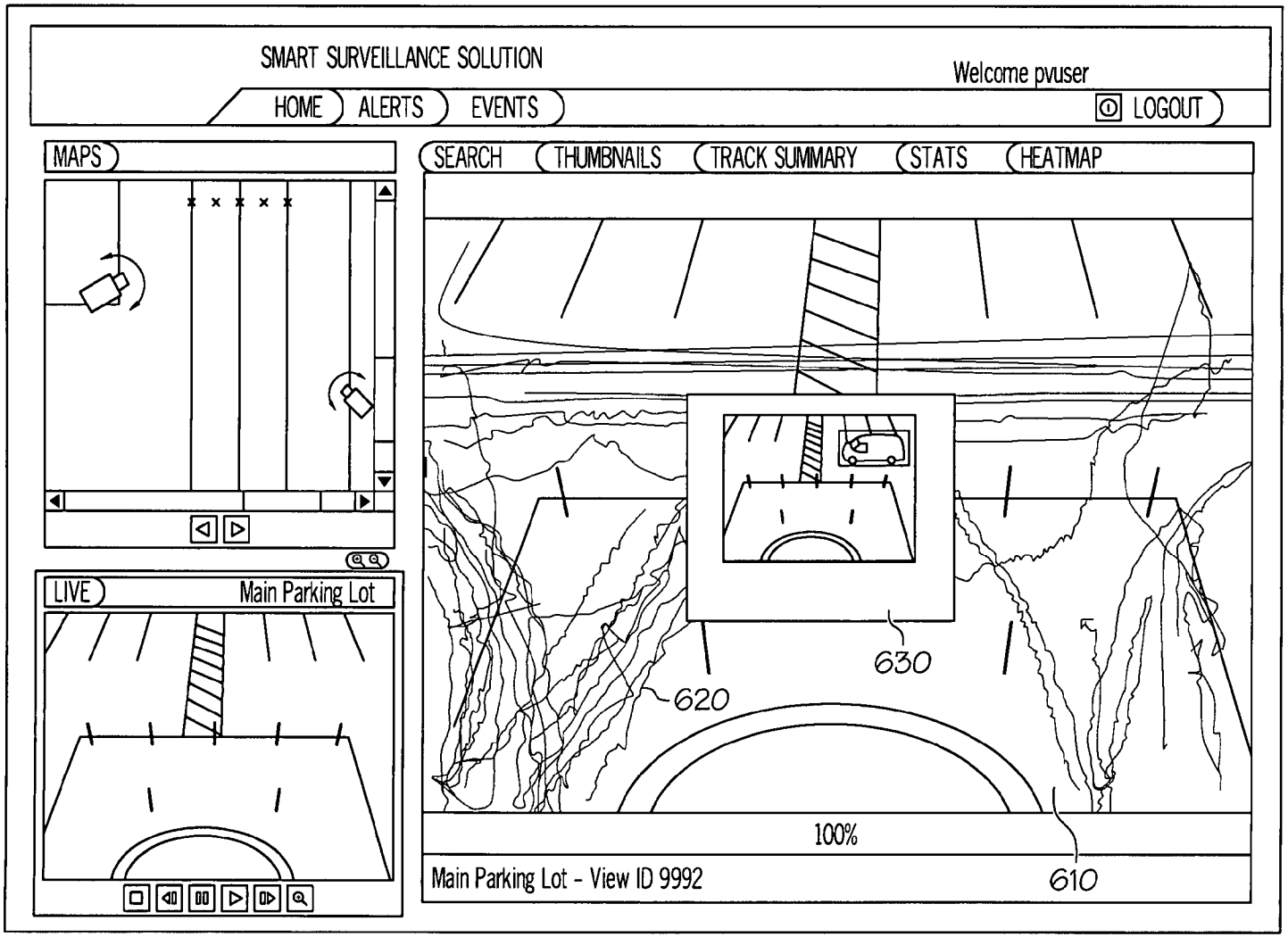

FIG. 6 shows the summary view of events. This view provides a spatial summary of the events the search results, thus providing the user with a visual pattern. Element 610 shows the keyframe overlayed with the tracks of objects. Element 620 shows the various tracks corresponding to events in the view. Element 630 shows the keyframe that pops up when the user performs a mouse over operation on one of the tracks. Rules that include annotating an input data stream with a boundary line may be specified, and an event is detected when an object crosses the boundary line.

Figure 7:
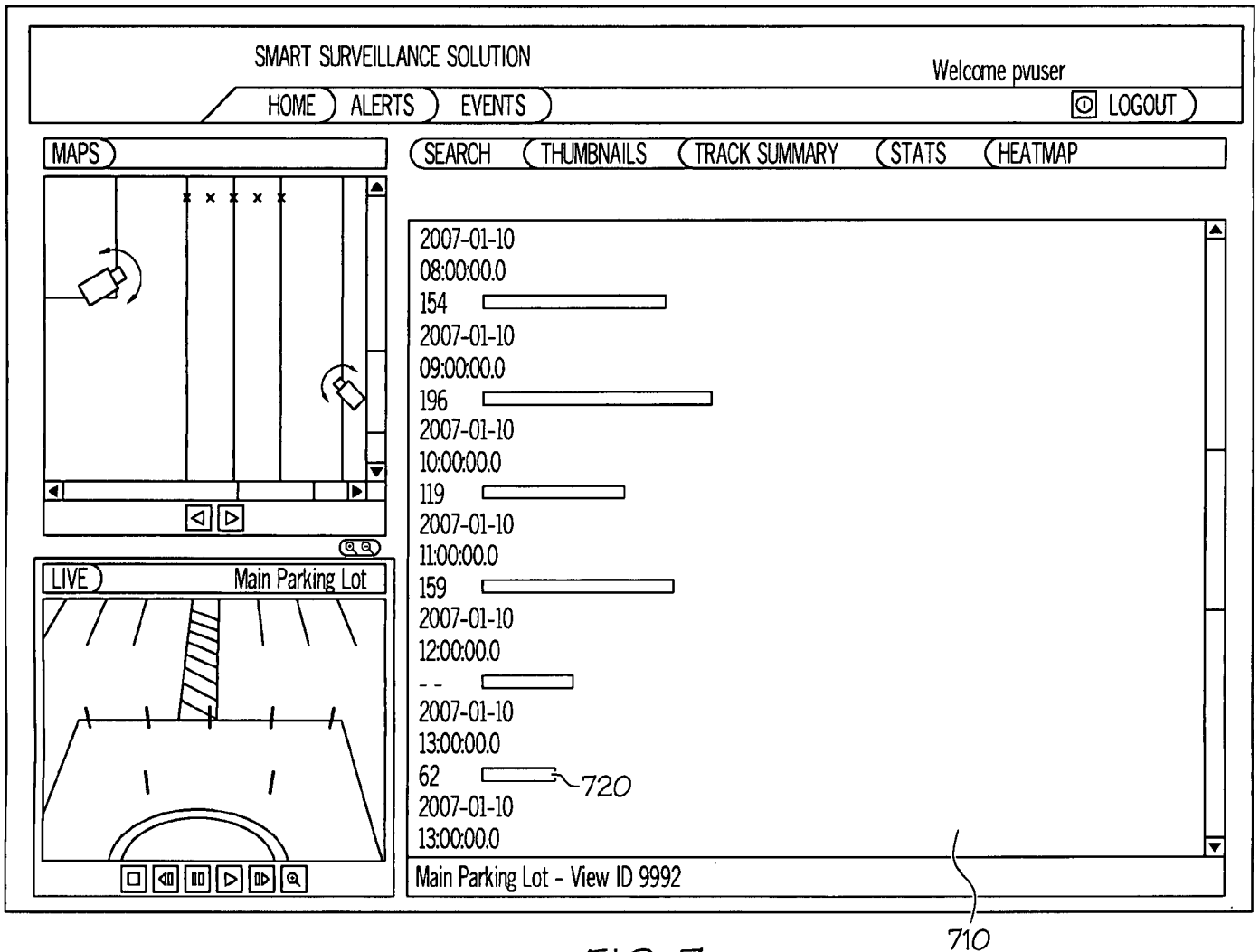

FIG. 7 shows a statistical view of events. This view provides a temporal distribution of events. Element 710 shows a series of bars at multiple points in time, for example 9 AM-10 AM, 10 AM-11 AM, soon in some fixed interval. In element 720, each bar represents the number of events that occurred in that time interval, the height of the bar corresponds to the number of events.

Figure 8:
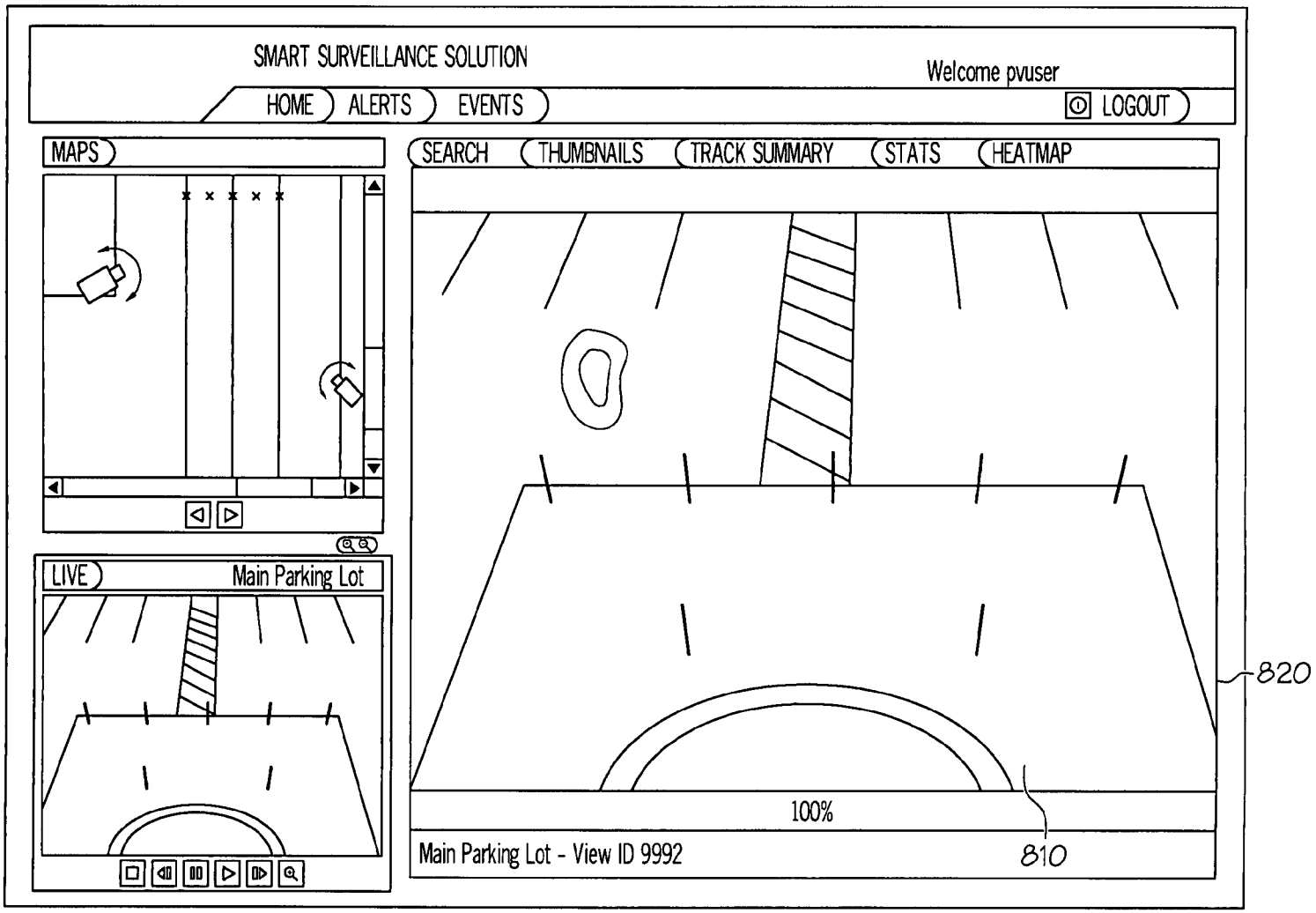

FIG. 8 shows a heatmap view of events. A heatmap shows the spatial distribution of some parameter of the activity. For example, dwell time in front of a shelf at a retail store. Element 810 shows a keyframe with color patterns overlaid on it, representing the summary of the parameter. Element 820 shows varying color representation where the intensity of the color represents the value of the parameter.

Figure 9:
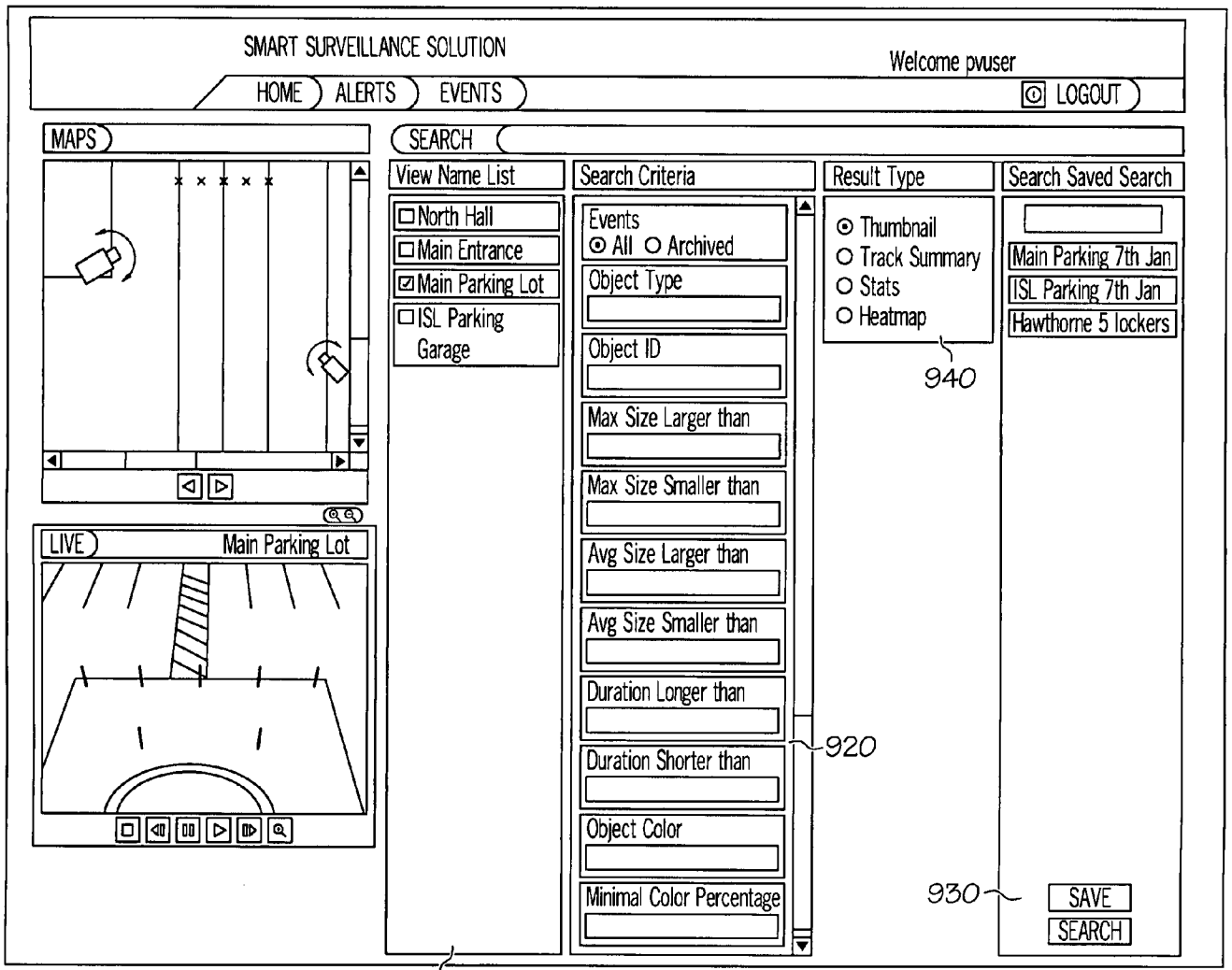

FIG. 9 shows the search interface through which the user can query the system. Element 910 shows the various cameras in the system and the user can select one or more cameras as the target of the search. Element 920 shows the various attributes on which the user can choose to launch the search. Element 940 shows the various visualizations that the user can choose, for example (thumbnail, track summary, heatmap or statistic view). Element 930 shows the various searches that have been saved by this user and provides the user with the capability to save a search.

The present invention reduces the risk of loss in key retail areas such as cashier fraud and returns fraud. The invention compares video stream with transaction telemetry:

Integrates with existing systems
Unlimited transaction query basis
Synchronization of video with transaction telemetry
Detection of questionable activity by cashier personnel Overall retail store management capabilities are significantly enhanced in several areas:

Improved Margins
Increased Accuracy
Reduced Internal Loss (~15-35%) and Errors
Reduced Operational Expense Improved Training, Increased Throughput
Cost Effective Deployment
Return on Investment=6 to 12 months While shown and described herein as an event detection method, it is understood that the invention further provides various alternative embodiments. For example, in one embodiment, the invention provides a computer-readable/useable medium that includes computer program code to enable a computer infrastructure to detect events. To this extent, the computer-readable/useable medium includes program code that implements each of the various process of the invention. It is understood that the terms computer-readable medium or computer useable medium comprises one or more of any type of physical embodiment of the program code. In particular, the computer-readable/useable medium can comprise program code embodied on one or more portable storage articles of manufacture (e.g., a compact disc, a magnetic disk, a tape, etc.), on one or more data storage portions of a computing device, such as memory and/or a storage system (e.g., a fixed disk, a read-only memory, a random access memory, a cache memory, etc.), and/or as a data signal (e.g., a propagated signal) traveling over a network (e.g., during a wired/wireless electronic distribution of the program code).

In another embodiment, the invention provides a business method that performs the process of the invention on a subscription, advertising, and/or fee basis. That is, a service provider, such as a Solution Integrator, could offer to detect events. In this case, the service provider can create, maintain, support, etc., a computer infrastructure that performs the process of the invention for one or more customers. In return, the service provider can receive payment from the customer(s) under a subscription and/or fee agreement and/or the service provider can receive payment from the sale of advertising content to one or more third parties.

In still another embodiment, the invention provides a computer-implemented method for detecting events. In this case, a computer infrastructure can be provided and one or more systems for performing the process of the invention can be obtained (e.g., created, purchased, used, modified, etc.) and deployed to the computer infrastructure. To this extent, the deployment of a system can comprise one or more of: (1) installing program code on a computing device from a computer-readable medium; (2) adding one or more computing devices to the computer infrastructure; and (3) incorporating and/or modifying one or more existing systems of the computer infrastructure to enable the computer infrastructure to perform the process of the invention.

As used herein, it is understood that the terms "program code" and "computer program code" are synonymous and mean any expression, in any language, code or notation, of a set of instructions intended to cause a computing device having an information processing capability to perform a particular function either directly or after either or both of the following: (a) conversion to another language, code or notation; and/or (b) reproduction in a different material form. To this extent, program code can be embodied as one or more of: an application/software program, component software/a library of functions, an operating system, a basic I/O system/driver for a particular computing and/or I/O device, and the like.

A data processing system suitable for storing and/or executing program code can be provided hereunder and can include at least one processor communicatively coupled, directly or indirectly, to memory element(s) through a system bus. The memory elements can include, but are not limited to, local memory employed during actual execution of the program code, bulk storage, and cache memories that provide temporary storage of at least some program code in order to reduce the number of times code must be retrieved from bulk storage during execution. Input/output or I/O devices (including, but not limited to, keyboards, displays, pointing devices, etc.) can be coupled to the system either directly or through intervening I/O controllers.

Network adapters also may be coupled to the system to enable the data processing system to become coupled to other data processing systems, remote printers, storage devices, and/or the like, through any combination of intervening private or public networks. Illustrative network adapters include, but are not limited to, modems, cable modems and Ethernet cards.

The foregoing description of various aspects of the invention has been presented for purposes of illustration and description. It is not intended to be exhaustive or to limit the invention to the precise form disclosed, and obviously, many modifications variations are possible. Such modifications and variations that may be apparent to a person skilled in the art are intended to be included within the scope of the invention as defined by the accompanying claims.

What is claimed is:

1. A system comprising:

at least one computing device configured to display event detection in surveillance by performing a method comprising:

generating a graphical interface for displaying the event detection in surveillance, the graphical interface comprising:

a map zone for displaying a location of at least one camera within a region being monitored;

a real-time alert visualization zone for displaying at least one alert from the at least one camera;

a camera zone for displaying at least one thumbnail from the at least one camera; and a live view zone for displaying a real-time data stream from one of the least one camera.

2. The system of claim 1, wherein each displayed camera in the map zone includes a color for indicating a corresponding alert status.

3. The system of claim 1, wherein each of the least one alert is displayed within the real-time alert visualization zone substantially contemporaneously with an occurrence of an event detected by the least one camera corresponding to the alert.

4. The system of claim 1, wherein the display of each alert within the real-time alert visualization zone includes a key-image from the at least one camera.

5. The system of claim 4, wherein each alert within the real-time alert visualization zone includes a colored bar for a user to assess patterns of types of alerts.

6. The system of claim 1, wherein each thumbnail is associated with a selection button for displaying a plurality of thumbnails for the selected camera corresponding to a user defined number of alerts.

7. The system of claim 6, wherein the camera zone displays the plurality of thumbnails for the selected camera corresponding to the user defined number of alerts.

8. The system of claim 7, wherein each of the plurality of thumbnails displays a trigger object corresponding to a user defined alert rule.

9. The system of claim 8, the graphical user interface further comprising a timeline zone for displaying a color-coded temporal sequence of alerts corresponding to the user defined alert rule.

10. A method for displaying event detection in surveillance, the method comprising:

generating a graphical interface for displaying an event detection in surveillance using a computer system including at least one computing device, the graphical interface comprising:

a map zone for displaying a location of at least one camera within a region being monitored;

a real-time alert visualization zone for displaying at least one alert from the at least one camera;

a camera zone for displaying at least one thumbnail from the at least one camera; and a live view zone for displaying a real-time data stream from one of the at least one camera.

11. The method of claim 10, further comprising generating a second graphical interface, the second graphical interface including:

The map zone;

The live view zone; and an alert database search zone for displaying search menus for enabling a user to define a search of a database of alerts.

12. The method of claim 11, wherein the alert database search zone includes a view name list for selecting at least one camera corresponding to an alert.

13. The method of claim 12, wherein a user may select more than one camera for a search.

14. The method of claim 11, wherein the alert database search zone includes a search criteria entry display for defining at least one of: an alert status, a keyword, or a time frame corresponding to an alert.

15. The method of claim 14, wherein the search criteria may be selected from a group including all and archived.

16. The method of claim 11, wherein the alert database search zone includes a result type selection display for configuring the display of results of the search.

17. The method of claim 11, wherein the alert database search zone includes a saved search display for enabling a user to save a defined search.

18. A program product embodied on a computer readable storage medium which when executed by a computing device enables the computing device to perform a method for displaying an event detection in surveillance on a graphical interface, the method comprising:

displaying a map zone, wherein the map zone includes a location of at least one camera within a region being monitored;

displaying a real-time alert visualization zone, wherein the real-time visualization zone includes at least one alert from the at least one camera;

displaying a camera zone, wherein the camera zone includes at least one thumbnail from the at least one camera; and displaying a live view zone, wherein the live view zone includes a real-time data stream from one of the at least one camera.

19. The program product of claim 18, further comprising, displaying a heat map, wherein the heat map includes a spatial distribution of a parameter of an activity.

20. The program product of claim 19, wherein the heat map includes a plurality of parameters, wherein each parameter represents a different activity.

* * * * *